US006837767B2

(12) United States Patent
Hitzschke et al.

(10) Patent No.: US 6,837,767 B2
(45) Date of Patent: Jan. 4, 2005

(54) METHOD FOR PRODUCING A DISCHARGE LAMP

(75) Inventors: Lothar Hitzschke, Munich (DE); Frank Vollkommer, Buchendorf (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 310 days.

(21) Appl. No.: 10/253,801

(22) Filed: Sep. 25, 2002

(65) Prior Publication Data

US 2003/0060116 A1 Mar. 27, 2003

(30) Foreign Application Priority Data

Sep. 27, 2001 (DE) ..... 101 47 727

(51) Int. Cl.[7] ..... H01J 9/32; H01J 9/38

(52) U.S. Cl. ..... 445/26; 445/40; 445/43

(58) Field of Search ..... 445/40, 41, 26, 445/43

(56) References Cited

U.S. PATENT DOCUMENTS 6,612,892 B1 * 9/2003 Lamouri et al. ..... 445/26

FOREIGN PATENT DOCUMENTS

| | | |
|---|---|---|
| WO | 02/27759 | 4/2002 |
| WO | 02/27761 | 4/2002 |

* cited by examiner

*Primary Examiner*—Joseph Williams
(74) *Attorney, Agent, or Firm*—Robert F. Clark

(57) ABSTRACT

A novel method for producing discharge lamps, in which discharge vessels 5 are filled in a chamber 4 with the required gas filling at normal pressure.

19 Claims, 2 Drawing Sheets

METHOD FOR PRODUCING A DISCHARGE LAMP

TECHNICAL FIELD

The present invention relates to a method for producing a discharge lamp. Discharge lamps generally have a discharge vessel for holding a gaseous discharge medium. A method for producing discharge lamps therefore necessarily includes the step of filling the discharge vessel with a gas filling and sealing the discharge vessel.

It is assumed in this description that the discharge lamp is at least largely finished after the sealing, for which reason the method of production is regarded with the sealing of a discharge vessel as having been concluded, at least in essence. Of course, this does not exclude the essentially finished discharge lamp from being further provided with electrodes, coated with reflective layers, connected to mounting devices or being further processed in another way after the sealing of the discharge vessel. The method of production in the sense of the claims is intended, however, to be regarded as already implemented with the sealing of the discharge vessel.

BACKGROUND ART

As a rule, discharge vessels of discharge lamps are fitted with exhaust tubes or other connections, via which discharge vessels can be evacuated and filled with the gas filling. These connections are generally sealed by fusing, whereupon projecting parts can be broken off or cut off.

The invention is directed in particular to discharge lamps designed for dielectrically impeded discharges, and chiefly, in this case, to so called flat radiators. In flat radiators, the discharge vessel is designed to be flat and of relatively large size by comparison with the thickness and has two substantially plane-parallel plates. The plates need not, of course, be flat in the strict sense of the word, but can also be structured. Flat radiators are of interest, particularly for the back lighting of displays and monitors.

Also known in this technical field are methods of production in which the discharge vessel is evacuated and filled in a so-called vacuum furnace. The vacuum furnace is in this case a chamber which can be evacuated and heated. As in the case of conventional exhaust tube solutions as well, the exhaustion removes undesired gases and adsorbates, in order to keep the gas filling of the finished discharge lamp as pure as possible.

Exhaust tube solutions and comparable procedures are associated with restrictions on the discharge vessel geometry. Methods in the vacuum furnace are cost-intensive owing to the technical outlay for the vacuum furnace, and otherwise comparatively time consuming.

DISCLOSURE OF THE INVENTION

The invention is based on the problem of specifying a method for producing a discharge lamp which is improved with regard to the step of filling and sealing the discharge vessel.

The invention is directed to a method for producing a discharge lamp, in which a discharge vessel of the discharge lamp is filled with a gas filling and then sealed, comprising the steps of filling and sealing of the discharge vessel in a chamber in which the gas filling is contained and normal pressure substantially prevails.

The invention proceeds from the finding that filling and sealing steps carried out in appropriately configured chambers are to be preferred to solutions with exhaust tubes or similar devices. They offer, in particular, the possibility of simultaneously processing relatively large numbers of discharge vessel units. Again, there are no boundary conditions for a discharge vessel design optimized in relation to the pumping and filling step through an exhaust tube connection, and to the sealing of the exhaust tube connection. Instead, the configuration of the discharge vessel is largely a matter of free choice and need only ensure manipulation of the discharge vessel parts which are to be interconnected for the purpose of sealing, or the steps otherwise required for sealing.

On the other hand, the inventors assume that a vacuum furnace signifies an outlay which is unnecessary with regard both to the costs of apparatus and to the processing times.

Instead, use is to be made according to the invention of a chamber in which the gas filling for the discharge vessel is present at normal pressure, that is to say substantially at atmospheric pressure. Thus, the chamber need not be evacuable. Instead, undesired residual gases are removed either by purging the chamber or by inserting the discharge vessels through a lock or the like. Owing to the elimination of the high-vacuum-tight sealing of the furnace, the chamber walls, which are fairly thick for underpressure and therefore exhibit thermal inertia, and the evacuation steps, the method of production is therefore rendered substantially cheaper and shortened. The chamber walls are therefore preferably at most 8 mm, better at most 5 mm and at most 2 mm thick in the optimum case in the large surface portions. Profile structures can occur in this case, of course.

It is preferably provided that the chamber can be heated, and so a furnace in the general sense is concerned. Owing to the heating, adsorbates and contaminants contained in specific constituents of the discharge vessel can be expelled and, in addition, other process steps can be initiated, as explained in further detail below. In particular, the heating can be necessary for the sealing of the discharge vessel. The chamber can preferably be heated entirely.

The chamber can, moreover, be open, and thus need not be completely sealed. It can, for example, be flowed through by a permanent current of gas which prevents penetration of contaminants through remaining openings in the chamber and/or keeps the fraction of such contaminants in the gas filling in the chamber sufficiently low.

However, it is to be stated expressly that the invention is implemented even if the chamber can be sealed, or is sealed during the filling step and the sealing of the discharge vessel.

In a preferred refinement of the invention, the discharge vessels are to be transported through the chamber with the aid of a conveyor, it being possible, of course, for them to be stopped in the chamber. In the case of a vacuum furnace, the vacuum chamber must be opened in a regularly complicated way for the purpose of unloading and reloading, a holder, arranged in the vacuum furnace, as a rule, for the already filled and sealed discharge vessels being exchanged for a holder with as yet unsealed discharge vessels. Owing to the abolition of the evacuation of the chamber and, therefore, the elimination of high-vacuum-tight sealing measures, the invention offers the possibility of a simplified and, possibly, also continuous or quasi-continuous transport of discharge vessels through the chamber.

In particular, the chamber can be integrated in a partially or completely automated production line which can also be served by a standard conveyer.

In addition, the method steps explained in greater detail below can also be carried out before the filling and sealing in a plurality of chambers which are each adapted to specific steps in terms of design and/or with regard to the gas atmospheres and temperatures.

In order to expel organic contaminants, for example binder materials in so called solder glass or phosphor layers and reflective layers, it can be advantageous to heat up the discharge vessel before the filling in an oxygen-containing atmosphere, for example in air. Here, this atmosphere can be kept permanently flowing in order to transport the expelled contaminants away.

Furthermore, the discharge vessel can be purged with an inert gas before the filling and, if appropriate, after the heating in the oxygen-containing environment. Moreover, in addition to the actual discharge gas, that is to say the gas whose light emission is utilized technically in the discharge (a discharge gas mixture also being possible), during the filling the gas mixture can also include further gases, in particular inert gases. The discharge gas is preferably Xe. The added inert gas can be Ne and/or He, for example. In particular, in addition to the discharge gas it is possible for another gas to be present which exhibits a Penning effect relative to the discharge gas, that is to say promotes an ionization of the discharge gas via its own excitation. This holds for Ne in the case of the discharge gas Xe. Furthermore, a buffer gas can be added which serves the purpose of obtaining a desired overall pressure in conjunction with a prescribed targeted partial pressure of the discharge gas and, if appropriate, the Penning gas. In this case, the partial pressures and the overall pressure must always be set during the filling such that they attain the targeted values in the case of the expected operating temperatures of the discharge lamp. Partial pressures (referred to room temperature) of 80–350 mbar, preferably 90–210 mbar and, with particular preference, 100–160 mbar are preferably to be selected for the discharge gas Xe.

Furthermore, it can be provided to connect an inert gas freezer and/or collector to the chamber in which a gas filling including inert gases is used for the filling, in order to be able to reuse at least a portion of the costly inert gases. In order not to have to design the inert gas freezer unit to be too large, or in order to limit the use of inert gas in the event of absence of such a freezer unit, the inert gas flow should be cut off immediately after the sealing of the discharge vessel. It is also possible in this case to switch over to another gas atmosphere or gas current which is more cost-effective. This is preferably air.

Overall, in order to minimize stresses and for the purpose of as uniform a temperature distribution as possible and accurate temperature control the gases flowing into the chamber should be substantially at the discharge vessel temperature present at this instant. This means that the deviations in the temperatures should as far as possible be not greater than +/−100 K, preferably not greater than +/−50 K, depending on the actual discharge vessel temperature.

In addition to the already mentioned embodiment of the invention with a conveyor passing through a plurality of specialized chambers, preference is also given, however, to a particularly simple embodiment in which the required method steps for heating, purging, filling and sealing the discharge vessel take place in one and the same chamber. The latter need not even necessarily then contain a conveyor. Thus, it is possibly also not operated continuously, but loaded and emptied in charges.

Thus, it can be necessary in the case of such chambers, as in the case of a vacuum furnace, to separate chamber parts from one another in order to charge and to empty the chamber interior. In this case, the regions of the chamber parts which come to bear against one another with the chamber closed are preferably provided with a vacuum channel via which this bearing surface can be exhausted when opening and sealing the chamber. This exhaustion serves, firstly, to keep contaminants out of the chamber interior (in a way comparable to a vacuum cleaner), while it is thereby possible, secondly, to press one chamber part against the other and, thirdly an effective sealing function can thereby be obtained. Specifically, the vacuum channel withdraws contaminants which could penetrate from outside before they reach the chamber interior. On the other hand, it produces a countercurrent of the gas present in the chamber interior, which furthermore prevents the penetration of contaminants. The vacuum channel can likewise be connected for this purpose to an inert gas collector or freezer.

BRIEF DESCRIPTION OF THE DRAWINGS

Two exemplary embodiments are described below which illustrate the invention in more detail. In the drawing.

BEST MODE FOR CARRYING OUT THE INVENTION

Figure 1:
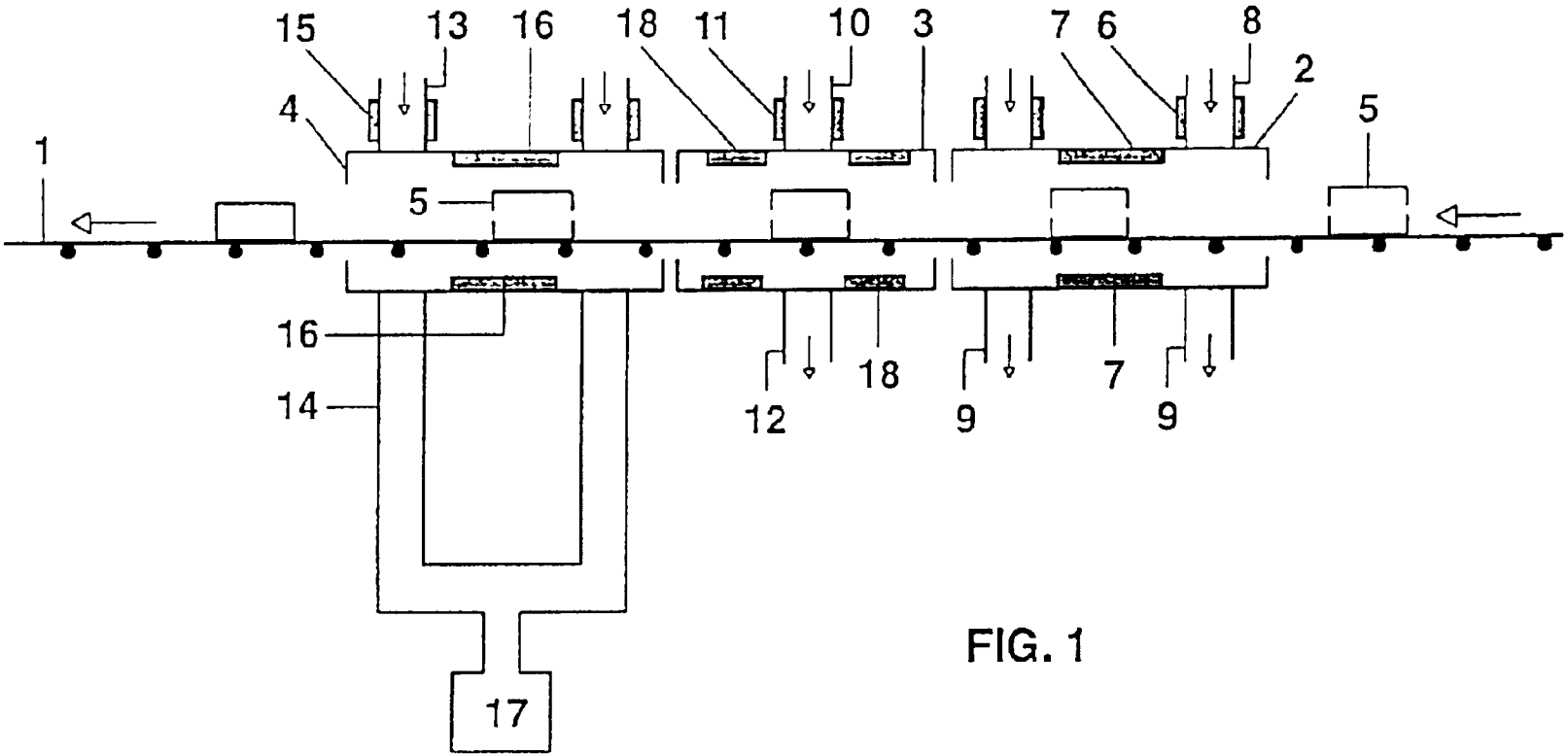
FIG. 1 shows a first exemplary embodiment for a production plant, according to the invention, for discharge lamps.

A flat radiator designed for dielectrically impeded discharges and whose discharge vessel comprises a cover plate and a base plate is produced as follows in the plant illustrated schematically in FIG. 1 as first exemplary embodiment. FIG. 1 shows the production plant in a schematic sectional illustration, with the horizontal in the plane of the paper corresponding to the transport direction of flat radiator discharge vessels on a conveyor belt 1. The conveyor belt 1 passes through three directly succeeding, but separate chambers 2, 3, 4, which are provided in each case for different tasks.

Illustrated by way of example on the conveyor 1 are five flat radiator discharge vessels which are being transported, the right-hand four of them being in the as yet unsealed state. FIG. 1 shows that the cover plate, situated above and including a frame, of each of these flat radiators is somewhat raised from the base plate situated below. This is done in a way known per se, but not illustrated, by interposing SF6 glass pieces which produce a sufficient spacing between the two plates. The left-hand discharge vessel is sealed, because it has already passed completely through the process illustrated in the Figure. The conveyor thus transports from right to left.

The following earlier patent applications from the same applicant may be referred to for the design details of the flat radiator discharge vessels: WO 02/27761 and WO 02/27759. All that is important for the present context is that the discharge vessel of the right-hand four lamps is open in each case, and the left-hand discharge vessel is closed.

As FIG. 1 shows, the discharge vessels are firstly transported into the chamber 2, which is open to the extent that the discharge vessels 5 can enter the chamber 2 and exit from it, without the need to actuate a sealing device for this purpose. Of course, it would also be possible for a sealing device to be present. In any case, normal atmospheric pressure prevails in the chamber 2.

Dried air which is preheated by electric heaters denoted by 6 flows into the chamber 2 through inlet channels 8 drawn in at the top in the Figure. At the same time, the chamber 2 contains an electric heater 7 for the interior, and so the discharge vessels 5 in the chamber 2 are purged with dry hot air and heated up in the process. Since the air contains oxygen, in addition to a first purging cleaning of the discharge vessel interior this process step expels, in particular, binder materials in the discharge vessel. The air consumed emerges through the outlet openings 9 drawn in at the bottom of the Figure.

After this process step, the discharge vessels 5 move into the next chamber 3, which is of substantially the same construction as the first chamber 2, but of somewhat shorter design in the transport direction in this example. The discharge vessels and, in particular, the discharge vessel interior are purged in this chamber with an inert gas, here Neon (Ne). The neon is inserted through an inlet opening 10, which corresponds in principle to the previous designs and is provided with an electric heater 11, and is led off through an outlet opening 12. The chamber 3 itself can be heated by the heater 18. It functions as a lock between the input chamber 2 and the contamination-sensitive chamber 4.

The discharge vessels 5 are then transported further by the conveyor 1 into the third chamber 4 which, in turn, has inlet openings 13 and outlet openings 14, and also largely corresponds, furthermore, to the two previous chambers. The inlet openings 13 have electric heaters 15; furthermore, the chamber 4 has an electric heating 16 for the interior.

In this chamber, the discharge vessel is firstly purged with a mixture of, for example, 51.2 vol % He, 12.8 vol % Ne and 36 vol % Xe, and filled at normal pressure. In this case, the gas mixture is preheated by the electric heater 15 and, furthermore, the temperature of the discharge vessel 5 is raised by the interior heating 16 so far that it finally reaches 530° C. At this temperature, SF6 parts which hold the upper cover plate high become so soft that the latter sinks. At the same time, a solder glass (type 501018 from the manufacturer $DMC^2$) already provided for sealing the frame, fitted on the cover plate, with the base plate is so soft that it is possible thereby to achieve a tight bonded connection between those two plates. As a result, the gas filling is enclosed between the plates in the discharge vessel 5, whereupon the discharge vessel 5 can be moved out of the chamber 4 and, if appropriate, further processed.

If another sealing temperature is used, for example, 470° C., it is necessary to use another ratio, for example 53.4% He, 13.3% Ne and 33.3% Xe in order to achieve the same Xe partial pressure at the operating temperature of the discharge lamp (approximately 50° C.).

The outlet openings 14 of the chamber 4 are guided to an inert gas freezer unit 17, where the inert gases used for the gas mixture in this chamber can be reobtained. At the end of an operation a switchover is made to dried air in the chamber 4. In the case of a discontinuous production of charges, the switchover could also be performed each time after the respective sealing.

Overall, the discharge vessels from chamber 2 to chamber 4 inclusive remain at the heightened temperature, the temperature firstly rising so high in the chamber 4 that the two plates can be joined to one another. Because of the electric preheating, the respective gas atmospheres are introduced with a temperature adapted substantially, that is to say to approximately 20 K exactly, to the respective temperature of the discharge vessels 5, in order to keep the temperature distribution uniform and the discharge vessels 5 free from stress. In addition, there can also be connected downstream of the chamber 4 a further chamber for slowly and uniformly cooling down the discharge vessels 5, and this is not drawn in here.

All the chambers 2, 3 and 4 operate at normal pressure and are not sealed off tightly from the environment in the actual sense. In this case, it is possible to perform exhaust operations in chamber 3 because of the lock function. Of course, care will be taken to avoid a disproportionally large loss of the gas atmosphere respectively being used through the opening for the discharge vessels 5. This holds in particular for the chamber 4. If appropriate, it is also possible to provide opening flaps or other sealing devices which in each case are opened for the passage of a discharge vessel 5 and thereafter sealed again.

Figure 2:
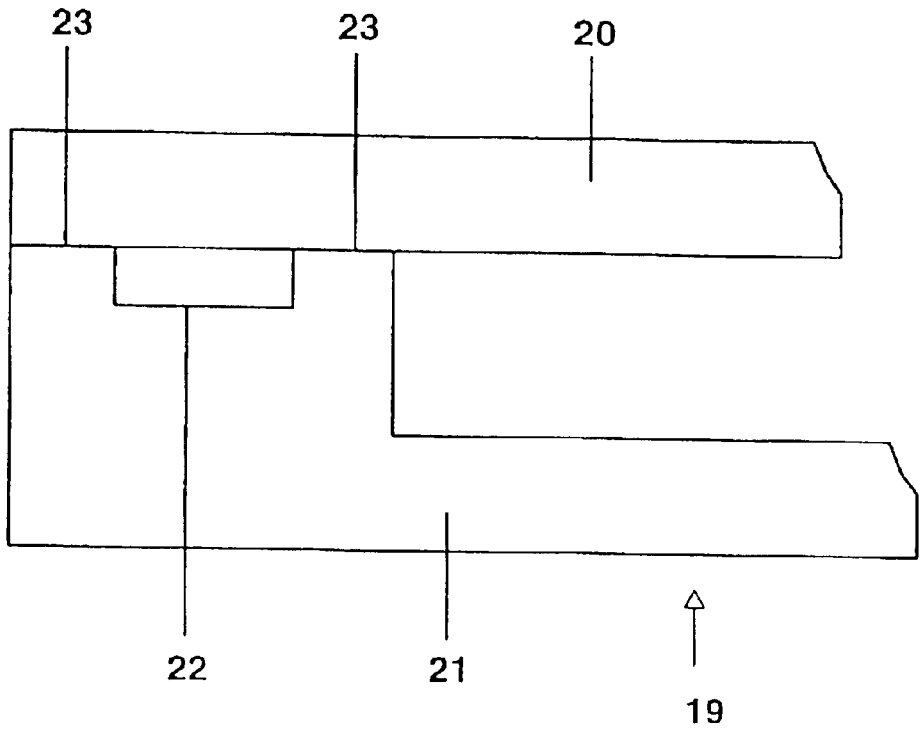
FIG. 2 shows a sketch of the principle of an alternative second embodiment.

FIG. 2 shows a sketch of a principle, which relates to a single chamber 19 for the entire process illustrated in FIG. 1. The corresponding gases and gas mixtures are to be supplied and led off in this chamber 19 in a way similar to that in FIG. 1, appropriate heaters being provided for the chamber 19 and for the gas supplies. The process steps are performed here however, one after another in one and the same chamber 19, which is purged through as appropriate between the process steps, in order to ensure an exchange of gas.

The chamber 19 need therefore not be provided with a conveyor, but is loaded and emptied in charges. For this purpose, an upper chamber cover 20 can be raised from a lower chamber part 21, chamber cover 20 and lower chamber part 21 being illustrated in FIG. 2 only schematically and in part. The geometry of the chamber 19 can be adapted individually to the discharge vessel geometries and charge sizes to be processed.

An essential feature of this second exemplary embodiment is the vacuum channel 22 indicated in FIG. 2, with the aid of which a bearing surface 23 between the upper chamber cover 20 and the lower chamber part 21 can be loaded. The cover 20 is thereby pressed onto the lower chamber part 21.

Moreover, the vacuum channel 22 has a cleaning function comparable to a vacuum cleaner in that it produces from the chamber interior (on the right in FIG. 2) a residual current along the bearing surface 23 to the vacuum channel 22, which current counteracts a penetration of contaminants (gaseous or of other type) into the chamber interior. Contaminants penetrating from outside along the bearing surface 23 are, furthermore, collected and led off through the vacuum channel 22.

Finally, particularly in the case of the initial opening and in the last phase of the sealing of the chamber 19, the vacuum channel has the effect of keeping the bearing surface 23 and its environment free from particles. Thus the vacuum channel 22 is a combination of a sealing device, a seal and a contaminant barrier.

As for the chambers 2, 3 and 4 from FIG. 1, it holds for the chamber 19 that very thin wall thickness can be used, because the chambers are not loaded by underpressure. A wall thickness of the order of magnitude of 1.5 mm is preferably provided here for the large surface portions of the chamber 19.

What is claimed is:

1. Method for producing a discharge lamp, in which a discharge vessel of the discharge lamp is filled with a gas filling and then sealed, comprising the steps of filling and sealing of the discharge vessel in a chamber in which the gas filling is contained and normal pressure substantially prevails.

2. Method according to claim 1, in which the chamber can be heated.

3. Method according to claim 1, in which the chamber is open.

4. Method according to claim 1, in which discharge vessels pass through the chamber on a conveyor.

5. Method according to claim 4, in which the discharge vessels pass through a plurality of chambers each individually adapted to an assigned method step.

6. Method according to claim 2, in which the discharge vessel is heated in an oxygen-containing atmosphere before the filling.

7. Method according to claim 1, in which the discharge vessel is purged with an inert gas before the filling and, if appropriate, after the heating in the oxygen-containing environment.

8. Method according to claim 1, in which the discharge vessel is filled with a gas filling which contains a buffer gas for increasing the internal pressure in addition to the discharge gas provided for the light generation.

9. Method according to claim 1, in which the discharge vessel is filled with a gas filling which, in addition to the discharge gas provided for the light generation, contains an inert gas with a Penning effect with reference to the discharge gas.

10. Method according to claim 1, in which the discharge gas provided for the light generation is Xe, and the discharge vessel is filled with a partial pressure of Xe such that at room temperature it includes an Xe partial pressure in the range of 80–350 mbar.

11. Method according to claim 1, in which an inert gas freezer or collector is connected to the chamber used for filling with the gas filling with the discharge gas provided for the light generation.

12. Method according to claim 1, in which the inert gas flow is cut off after the sealing of the discharge vessel.

13. Method according to claim 12, in which a switchover is made to a more cost-effective gas after the sealing of the discharge vessel.

14. Method according to claim 3, in which the gas filling containing the discharge gas provided for the light generation and, if appropriate, gases to be introduced thereafter into the chamber flow in at a temperature which corresponds substantially to the discharge vessel temperature present in this case.

15. Method according to claim 1, in which the chamber has at least for the most part wall thickness of 8 mm and below.

16. Method according to claim 1, in which the discharge vessel is heated, purged, filled and sealed in one and the same chamber.

17. Method according to claim 16, in which the chamber can be opened by separating two chamber parts, and a pressure force can be applied to a bearing surface between the two chamber parts via a vacuum channel.

18. Method according to claim 1, in which the discharge lamp is designed for dielectrically impeded discharges.

19. Method according to claim 1, in which the discharge lamp is a flat radiator with a discharge vessel which has two substantially plane-parallel discharge vessel plates.

* * * * *